US008523033B2

(12) United States Patent
Takeji

(10) Patent No.: US 8,523,033 B2
(45) Date of Patent: Sep. 3, 2013

(54) TAPE CUTTER

(76) Inventor: Mikio Takeji, Tokyo (JP)

( * ) Notice: Subject to any disclaimer, the term of this patent is extended or adjusted under 35 U.S.C. 154(b) by 443 days.

(21) Appl. No.: 12/307,141

(22) PCT Filed: Oct. 11, 2006

(86) PCT No.: PCT/JP2006/320301

§ 371 (c)(1),
(2), (4) Date: Dec. 31, 2008

(87) PCT Pub. No.: WO2008/044291

PCT Pub. Date: Apr. 17, 2008

(65) Prior Publication Data

US 2009/0277942 A1 Nov. 12, 2009

(51) Int. Cl.
*B26F 3/02* (2006.01)

(52) U.S. Cl.
USPC ..... 225/20; 225/21

(58) Field of Classification Search
USPC ..... 225/20, 21, 19, 22; 83/397, 398
See application file for complete search history.

(56) References Cited

U.S. PATENT DOCUMENTS

| | | | | | |
|---|---|---|---|---|---|
| 744,637 | A | * | 11/1903 | Soennecken | 83/567 |
| 833,470 | A | * | 10/1906 | Lipowsky | 83/570 |
| 2,107,487 | A | * | 2/1938 | Machate et al. | 225/36 |
| 2,290,223 | A | * | 7/1942 | Black et al. | 83/397 |
| 2,663,369 | A | * | 12/1953 | Erhardt | 225/20 |
| 3,991,923 | A | * | 11/1976 | Nishikawa | 225/20 |
| 5,938,580 | A | * | 8/1999 | Siekmann | 493/38 |
| 2009/0078733 | A1 | * | 3/2009 | Yagyu | 225/77 |

FOREIGN PATENT DOCUMENTS

| | | | |
|---|---|---|---|
| JP | 50-154391 | | 12/1975 |
| JP | 50-154391 | A | 12/1975 |
| JP | 01-231763 | A | 9/1989 |
| JP | 01-308359 | A | 12/1989 |
| JP | 02-34564 | | 3/1990 |
| JP | 02-34564 | A | 3/1990 |
| JP | 04-97763 | | 8/1992 |
| JP | 04-97763 | A | 8/1992 |
| JP | 11-208974 | A | 8/1999 |
| JP | 2006-290572 | A | 10/2006 |

OTHER PUBLICATIONS

International Search Report for International application No. PCT/JP2006/320301 mailed Nov. 7, 2006.

* cited by examiner

*Primary Examiner* — Kenneth E. Peterson
(74) *Attorney, Agent, or Firm* — Cantor Colburn LLP

(57) ABSTRACT

A tape cutter may include a tape-sticking portion separated from a blade and configured to slide in the up-and-down direction, and a pair of arm-like edge guards arranged at opposite sides of the blade and configured to be opened/closed while interlocking with up/down motion of the tape-sticking portion, and a rear holder holds the tape-sticking portion to be slidable and the edge guards to be rotatable, and a connection portion for interlocking the tape-sticking portion with the pair of arm-like edge guards is arranged to be located between the rotational centers of the pair of arm-like edge guards.

2 Claims, 5 Drawing Sheets

TAPE CUTTER

CROSS REFERENCE TO RELATED APPLICATIONS

This is a U.S. national stage of application No. PCT/JP2006/320301, filed on 11 Oct. 2006.

TECHNICAL FIELD

The present invention relates to a tape cutter.

BACKGROUND ART

Many and various types of desktop tape cutters have been developed and commercialized. Among them, a number of impressive examples are roughly classified into the following three types. First, some tape cutters are unique in a tape-mounting method or in a reel-supporting method, according to which a user can replace a tape from the side while leaving a reel supported by a main body, or according to which a tape is laid on its side with a rotational shaft extending in the vertical direction so that the tape is twisted by 90 degrees between a sticking portion and the reel. Some other tape cutters are furnished with additional functions. For example, a tape cutter includes a rotary plate attached to the bottom thereof to make a yaw motion with the rotational angle of 360 degrees. An other tape cutter can serve as a penholder. Yet another tape cutter includes a mechanism configured to lift the leading end of a tape, after the tape is cut, to thereby enable a user to pick up the raised leading end with the fingers. Moreover, to prioritize safety of a finger, some other tape cutters are equipped with a mechanism for rotating a blade portion to house the cutting edge of the blade, or are equipped with a cover to conceal the same.

For example, a conventional tape cutter includes a linear blade, rather than a general saw blade, with a mechanism capable of ensuring safety of a finger at the cutting edge of a blade. As is understood from T30 by Elm Corp., a pair of rotatable ball-like edge guards can be provided on upper opposite sides of a blade to allow a tape to pass between the guard balls while being folded in a V shape and prevent a finger from passing. Furthermore, as understood from ST51 by Lion Office Products Corp., a sliding plate can be provided in front of and adjacently to a blade so that the plate can conceal the cutting edge when the blade is not used. When a user applies pressing force to cut a tape, the tape is moved downward and pulled forward by the applied force while a tape-sticking portion swings in the back-and-forth direction to move the plate downward. However, the above-described products have some problems in usability. Strictly speaking, neither one of the products can prevent a finger from touching the cutting edge of a blade. Related applications are Japanese Laid-Open Patent Application No. hei 1-231763 and Japanese Laid-Open Patent Application No. hei 1-308359.

DISCLOSURE OF THE INVENTION

Problems to be Solved by the Invention

To cut a tape well, use of a sharp blade is desired. However, to attach a sharp blade, a tape cutter is required to ensure safety of a finger at the cutting edge of the blade. In other words, any sharp blade can be attached to a tape cutter if the tape cutter is capable of preventing a finger from contacting with the cutting edge of the blade.

An object of the present invention is to provide a tape cutter capable of preventing a finger from contacting the cutting edge of a blade, by a sticking portion and a guard plate that can slide in the up-and-down direction and a pair of guard arms configured to be opened/closed while interlocking with up/down motion of the sticking portion. Thus, a user can attach a sharp blade to the tape cutter and can use the tape cutter safely and comfortably.

Means for Solving the Problems

To attain the above-described object, a tape cutter according to the present invention employs the following method.

A tape-sticking portion, separated from a blade and configured to slide in the up-and-down direction, and a pair of arm-like edge guards, i.e., guard arms, arranged at opposite sides of the blade and which interlocks to conceal the cutting edge of a blade such that the guard arms are opened when the sticking portion is raised and closed when the sticking portion is lowered, are provided.

To enhance safety, a planar edge guard; i.e., guard plate, movable in the up-and-down direction together with the sticking portion is provided in front of the blade.

To prevent the raised sticking portion from falling due to its own weight and closing the guard arms after a tape is peeled off the sticking portion, a magnet can be attached to the sticking portion. When the magnet moves upward together with the sticking portion, the magnet, generating magnetic force, can attract the lower edge of the iron blade. Thus, the magnet enables the guard arms to temporarily sustain the opened state.

The sticking portion and its holder can incline when they are pulled toward the reel side under the tensile force applied to a tape to peel the tape off the sticking portion. After the tape is peeled off the sticking portion, the sticking portion and its holder return to their original positions.

The above-described means for solving the problems have the following functions.

When a user pulls a tape to peel it off the sticking portion, the force induced by a peel resistance acting on a tape adhesion surface causes the sticking portion to move upward. On the other hand, when a user cuts the tape, the tape presses the sticking portion downward. These forces can be used to automatically open and close the guard arms.

If a magnet is used to temporarily sustain the opened state of the guard arms in a condition where the sticking portion is raised, the resistance during a raising operation of the sticking portion is small as compared with that found in another method using elasticity and friction of a spring or a resin, or a method using gravity. Furthermore, when the magnet approaches the lower end of the blade, the magnetic force can assist the sticking portion in rising.

To let the sticking portion rise smoothly, a bearing position of the reel is desirably slightly higher than a leading end of the tape if the sticking portion slides in the vertical direction. When such an arrangement is realized, the locus of a top surface of the sticking portion moving in the up-and-down direction can be positioned inside a circular locus along which the leading end of the tape travels in a state where a wound tape is not yet peeled off. However, this arrangement may add restrictions in designing an appearance. However, if the sticking portion inclines toward the reel when a user starts to raise a tape, the distance between the sticking portion and the reel decreases and the tape is bent loosely between the sticking portion and the reel. The difference between the sliding direction of the sticking portion and the tape-pulling direction becomes smaller. Therefore, even if the bearing position of the reel is designed to have a smaller height, the sticking portion can be raised smoothly.

After the tape is peeled off the sticking portion, the guard arms are sustained in the opened state. In this condition, the guard plate and the sticking portion positioned in front of or in back of the blade can conceal the cutting edge of the blade. During a tape-cutting operation or when the cutting operation is finished, the guard arms are closed to conceal the cutting edge of the blade.

A user may press the sticking portion down with a finger to intentionally touch the cutting edge of the blade in the state where the guard arms are opened. However, if the sticking portion moves downward, the guard arms are closed. The downward motion of the sticking portion is stopped if the finger is clamped by the guard arms. As the sticking portion is interlocked with the guard arms and cannot move further downward, the finger cannot reach the cutting edge of the blade. If a user performs a tape-cutting operation, the guard plate moves to the lowermost end and its upper end is positioned slightly lower than a cutting edge line. If the user intentionally tries to touch the cutting edge of the blade after completing the tape-cutting operation, the user is required to open the guard arms with the fingers. If the guard arms are opened, the guard plate rises correspondingly. In any event, the user's finger cannot touch the cutting edge of the blade.

Effect of the Invention

The guard arms, the guard plate, and the sticking portion, which are positioned above or in front or back of a blade, can conceal the cutting edge of the blade. A user cannot touch the cutting edge of the blade even intentionally. Thus, safety of a finger at the cutting edge of the blade can be reliably ensured. Thus, a sharp blade having a straight cutting edge line can be attached. When a linear blade is used, no indentation is formed along the cutting line of a tape. Therefore, the tape is not torn obliquely when a user applies a pulling force to the cut edge of the tape. Therefore, a user can easily peel off a piece of tape. The cutting line of a piece of tape is good in appearance.

The opening/closing operation of the guard arms can be automatically, without requiring the user's attention, performed using the force applied when a piece of tape is peeled off the sticking portion and the force applied when the piece of tape is to pressed against the sticking portion. In other words, the guard arms can be opened or closed by an operation substantially similar to that of a conventional common tape cutter.

The sticking portion can incline toward the reel side. Therefore, even if the reel-bearing position is designed to have a smaller height, the sticking portion can rise smoothly. Therefore, the degree of freedom in designing the appearance can be increased. Furthermore, using a magnet capable of sustaining the opened state of the guard arms enables the mechanism to operate smoothly and accurately. A tape cutter according to the present invention can be used widely, although a tape-raising method is variable, depending on the state in operation or depending on the user's preference. The problem such that apiece of tape is peeled off the sticking portion before the sticking portion is completely raised can be solved. Therefore, the tape cutter according to the present invention can be used for a masking tape or any other tape having a lower level of adhesion.

BEST MODE FOR CARRYING OUT THE INVENTION

An embodiment of the present invention will now be described with reference to the drawings. FIG. 1 is a front view illustrating guard arms in a closed state. FIG. 2 is a front view illustrating a sticking portion in a raised state and the guard arms in an opened state. FIG. 3 is a side view illustrating the guard arms in a closed state.

As an arrangement of parts, this mechanism includes essential parts incorporated in a space between a front holder 9 and a rear holder 8. A blade 6 is fixed to the front holder with screws. Right and left guard arms 3 can rotate about two holder pins 14 protruding from the rear holder. The right and left guard arms are mutually symmetrical about a plane and constitute a mirror-image arrangement. In other words, the rear holder 8 holds the edge guards 3 in a rotatable state.

A sticking portion 4 has a shape symmetrical with respect to the right and left direction. The sticking portion can slide in the up-and-down direction between the blade 6 and the rear holder 8. The sticking portion has two elongated holes, which prevent the sticking portion from interfering with the holder pins 14 protruding from the rear holder. Two interlocking pins 15, which are offset inward from the holder pins 14, can interlock the sticking portion with the right and left guard arms 3. That is, the rear holder 8 holds the sticking portion 4 in a slidable state. Moreover, providing the connection portion which interlocks the sticking portion 4 with the edge guards 3 so as to be located between the two rotational centers of the right and left edge guards determines the rotational direction of the edge guards against the up/down motion of the sticking portion. The right and left edge guards are provided symmetrically so that when one side rotates to the left, the other side rotates to the right. In other words, the arm-like edge guards are opened when the sticking portion is raised and the arm-like edge guards are closed when the sticking portion is lowered.

The guard arms 3 have proximal ends where holes are provided to receive the holder pins 14 protruding from the rear holder and elongated holes are opened to receive the interlocking pins 15 protruding the sticking portion. The guard arms 3 rotate about the holder pins 14, which are stationary, while interlocking with the motion of the interlocking pins 15 on the sticking portion, which can move. More specifically, the guard arms simultaneously open and close in association with up/down motion of the sticking portion. FIG. 4 illustrates a positional relationship between the holder pins 14 and the interlocking pins 15 in a state where the guard arms are closed. FIG. 5 illustrates a positional relationship between the holder pins 14 and the interlocking pins 15 in a state where the guard arms are opened. The arm portions exposed to the outside have lower and rear cutout portions, which can prevent an operation of the arm portions from interfering with the sticking portion. The reason for having elongated holes as holes to receive the interlocking pins 15 is to interlock the up/down motion of the sticking portion and the rotational movement of the edge guards with each other. For a link configured with three pieces of elements, when one side slides and the other side rotates, its connection portion slides while rotating at the same time, so that the holes for receiving the pins need to be formed as elongated holes.

A guard plate 5, having a U-shaped configuration and positioned between the front holder 9 and the blade 6 fixed to the front holder, is independent of the sticking portion. The guard plate 5 has protrusions provided on right and left sides thereof, which are engageable with notches 17 provided on the sticking portion. When integrated, the guard plate 5 and the sticking portion can move together in the up-and-down direction. FIG. 6 illustrates the position of the blade in a state where the guard arms are opened. FIG. 7 illustrates the guard plate assembled with the sticking portion. The blade 6 is a linear blade.

A magnet 7 is fixed to the lower portion of the sticking portion. When the sticking portion is raised, the magnet 7 can reach the lower end of the blade 6 under the magnetic force generated by the magnet 7. FIG. 8 illustrates the sticking portion in a lowered state. FIG. 9 illustrates the sticking portion in a raised state where the magnet is bought into contact with the blade.

The rear holder 8 is attached to the tape cutter main body via a shaft 10, which extends through a lower hole. The rear holder 8 can swing in the back-and-forth direction about the shaft. The rear holder has a rear end portion, which is pressed upward by a coil spring 11 placed on a main body bottom board 13, as illustrated in FIG. 10.

An operation of the above-described mechanism, when used by a user, is described below.

First, if a user pulls a piece of tape to peel it off the sticking portion, the sticking portion is pulled toward the reel side under tensile force of the tape. Both the front and rear holders incline rearward. Next, the force induced by a peel resistance acting on a tape adhesion surface causes the sticking portion to move upward. In association with this movement, the guard arms are opened gradually. The motion is stopped when the magnet fixed to the lower end of the sticking portion is brought into contact with the lower end of the blade. Then, the piece of tape is removed off the sticking portion.

If the tape is pulled out by a required length, the guard arms are required to be opened until the tape is pressed against the sticking portion. The magnet can generate a magnetic force sufficient to sustain this condition. If the tape is peeled off the sticking portion, the front and rear holders are immediately released from the rearwardly inclined condition and returned to the original positions by the coil spring.

If a user presses a tape against the sticking portion to cut the tape, the sticking portion is moved downward by the applied force. The guard arms, interlocking with the motion of the sticking portion, are gradually closed while they follow the lowering tape.

For example, in a state where a tape is removed off the sticking portion for replacement of the tape, the guard arms are closed and can be easily opened by the fingers of a user. If the guard arms are opened, the sticking portion rises and the magnet sustains the opened state.

EXPLANATIONS OF REFERENCE NUMERALS

Figure 1:
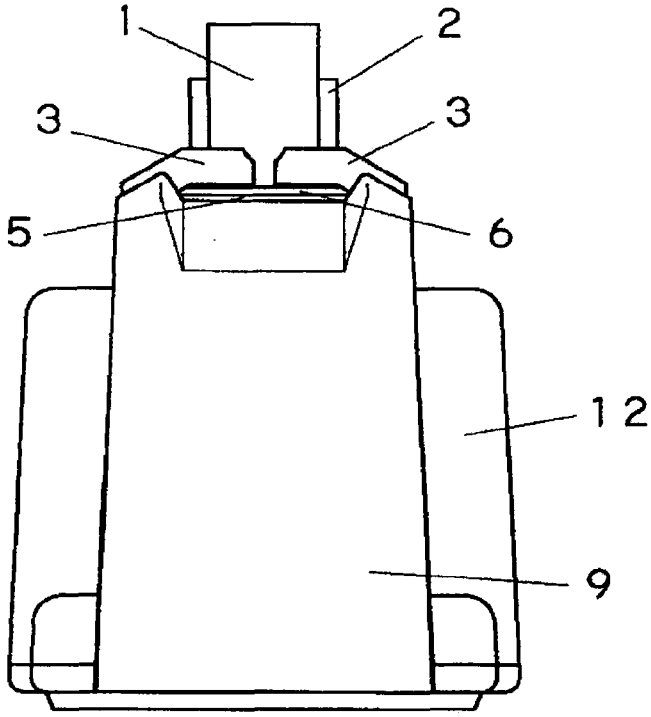
FIG. 1 is a front view illustrating guard arms in a closed state.
Figure 2:
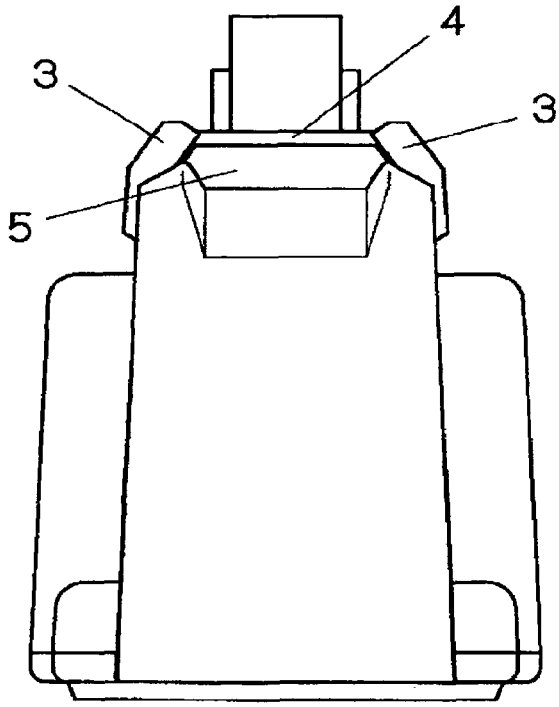
FIG. 2 is a front view illustrating guard arms in an opened state.
Figure 3:
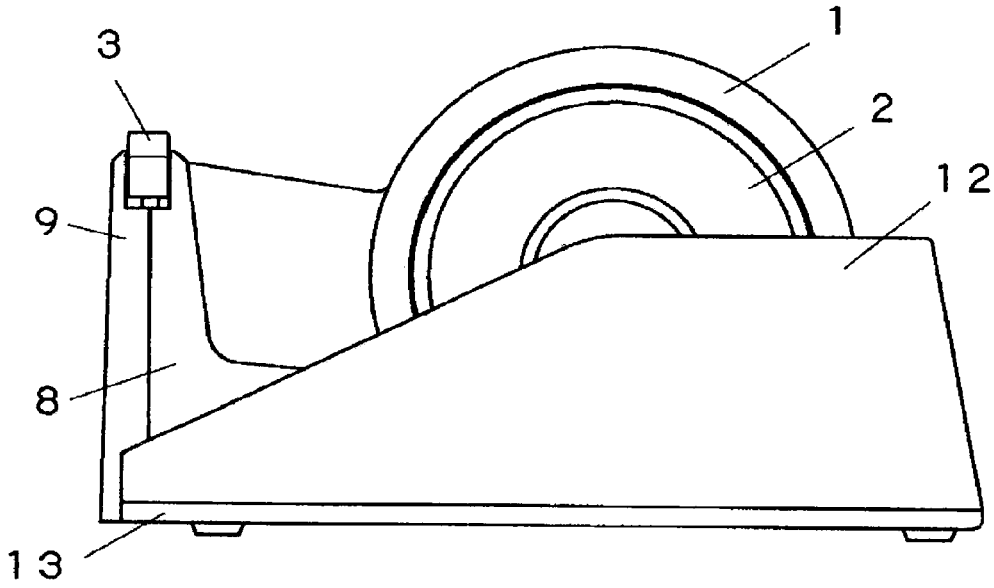
FIG. 3 is a side view.
Figure 4:
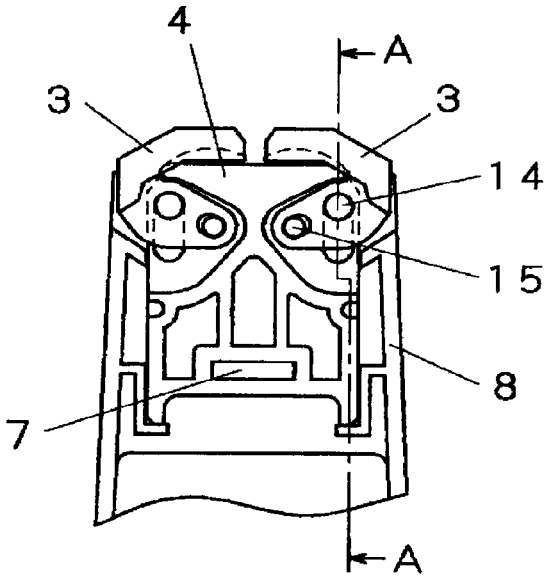
FIG. 4 illustrates a rear holder, a sticking portion, and the guard arms (in a closed state), which are assembled together.
Figure 5:
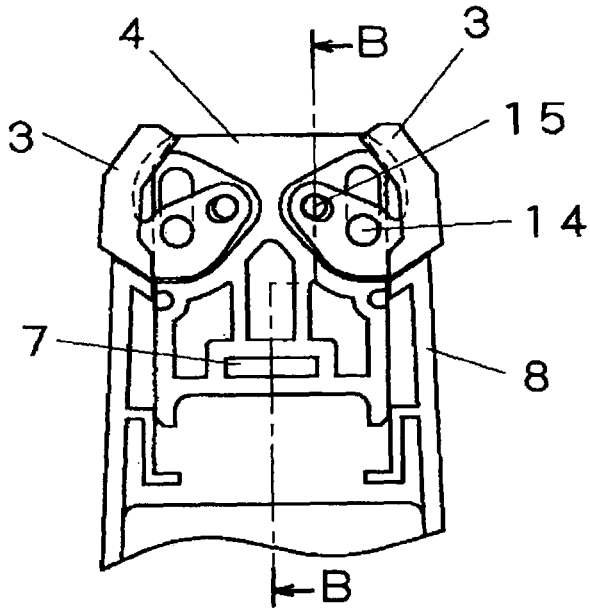
FIG. 5 illustrates the rear holder, the sticking portion, and the guard arms (in an opened state), which are assembled together.
Figure 6:
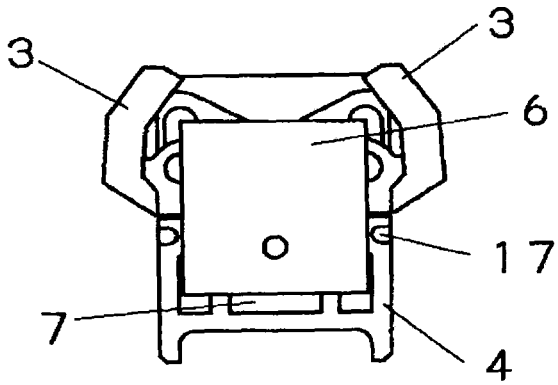
FIG. 6 illustrates the position of a blade.
Figure 7:
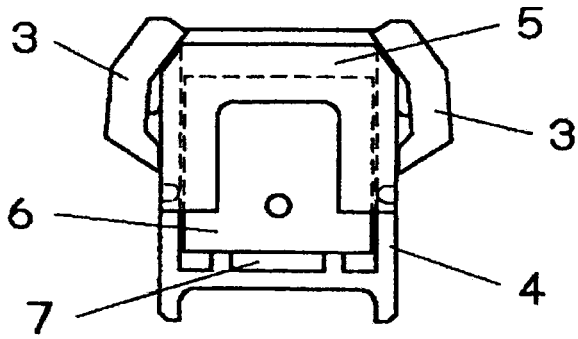
FIG. 7 illustrates a guard plate attached to the sticking portion.
Figure 8:
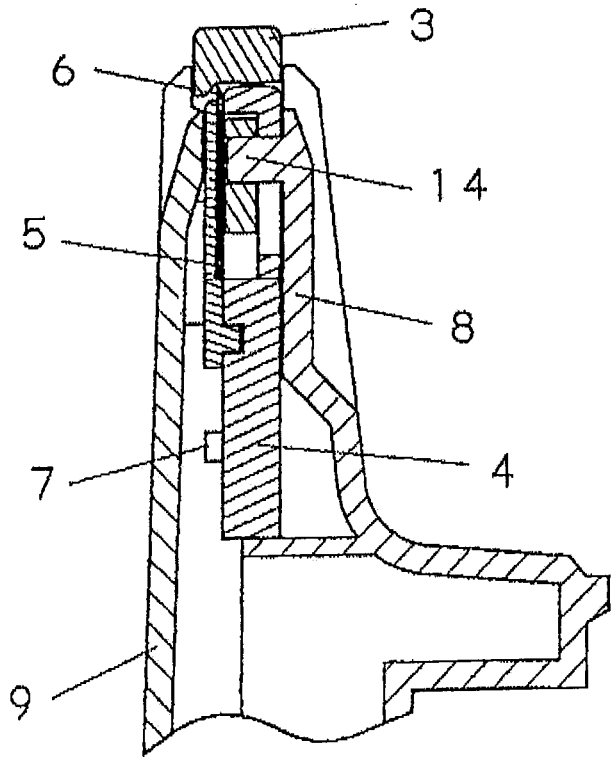
FIG. 8 is across-sectional view taken along a line A-A passing through holder pins 14.
Figure 9:
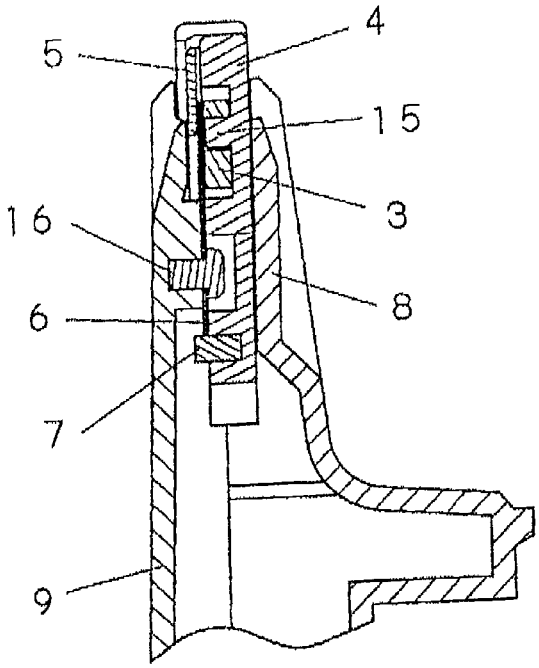
FIG. 9 is across-sectional view taken along a line B-B passing through interlocking pins 15.
Figure 10:
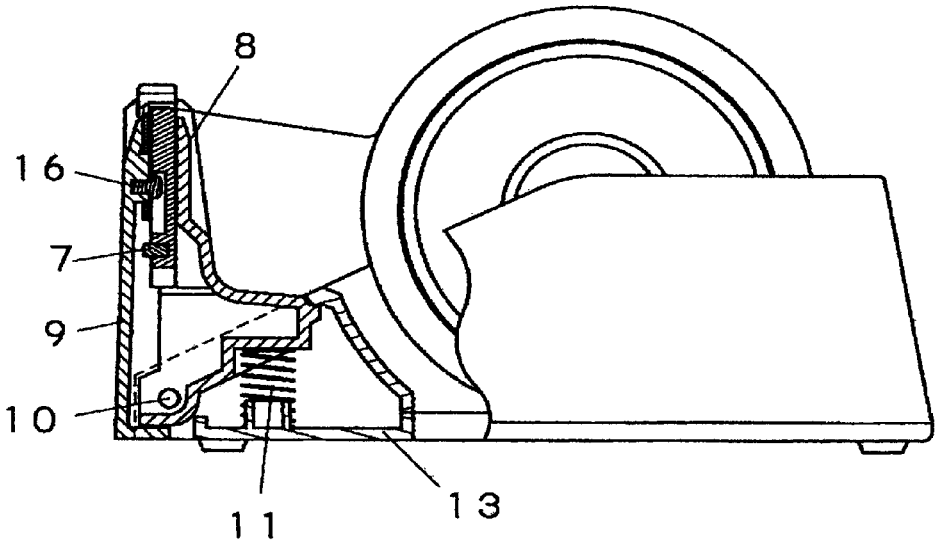
FIG. 10 is a partly sectional view illustrating a central portion.

1 tape
2 reel
3 guard arm
4 sticking portion
5 guard plate
6 blade
7 magnet
8 rear holder
9 front holder
10 shaft
11 coil spring
12 main body
13 main body bottom board
holder pin
15 interlocking pin
16 screw
17 notch

The invention claimed is:

1. A tape cutter comprising:

a tape-sticking portion separated from a blade and configured to slide in the up-and-down direction; and a pair of arm-like edge guards arranged at opposite sides of the blade and configured to be opened away from each other and closed toward each other while interlocking with the up-and-down motion of the tape-sticking portion;

wherein a rear holder holds the tape-sticking portion to be slidable and the edge guards to be rotatable, and wherein a connection portion for interlocking the tape-sticking portion with the pair of arm-like edge guards is arranged to be located between the rotational centers of the pair of arm-like edge guards, such that the guards are opened when the sticking portion is raised and the guards are closed on top of the sticking portion when the sticking portion is lowered.

2. The tape cutter according to claim 1, wherein a planar edge guard movable in the up-and-down direction together with the sticking portion is provided in front of the blade.

* * * * *